US007196504B2

(12) United States Patent
Itoh

(10) Patent No.: US 7,196,504 B2
(45) Date of Patent: Mar. 27, 2007

(54) CONSTANT-VOLTAGE CIRCUIT, SEMICONDUCTOR DEVICE USING THE SAME, AND CONSTANT-VOLTAGE OUTPUTTING METHOD

(75) Inventor: Kohzoh Itoh, Hyogo-ken (JP)

(73) Assignee: Ricoh Company, Ltd. (JP)

( * ) Notice: Subject to any disclaimer, the term of this patent is extended or adjusted under 35 U.S.C. 154(b) by 0 days.

(21) Appl. No.: 11/332,163

(22) Filed: Jan. 17, 2006

(65) Prior Publication Data

US 2006/0164060 A1 Jul. 27, 2006

(30) Foreign Application Priority Data

Jan. 26, 2005 (JP) ..... 2005-018337

(51) Int. Cl.
*G05F 1/40* (2006.01)

(52) U.S. Cl. ..... 323/280; 323/281

(58) Field of Classification Search ..... 323/280, 323/281, 274

See application file for complete search history.

(56) References Cited

U.S. PATENT DOCUMENTS 5,739,681 A * 4/1998 Allman ..... 323/314

2005/0231180 A1 10/2005 Nagata et al.

FOREIGN PATENT DOCUMENTS

JP 2002-274944 4/2004

* cited by examiner

*Primary Examiner*—Shawn Riley
(74) *Attorney, Agent, or Firm*—Dickstein Shapiro LLP

(57) ABSTRACT

A constant-voltage circuit includes a first transistor, a first control circuit, and a second control circuit having a second transistor and a differential amplifier. The first transistor controls an output current according to a first control signal output by the first control circuit such that an output voltage is substantially equal to a predetermined voltage. The second control circuit has a response property faster than the first control circuit to a variation of the output voltage, and causes the first transistor to increase the output current for a predetermined time period, regardless of the first control signal, when the output voltage varied to an extent greater than a predetermined output voltage variation value. The second transistor controls an operation of the first transistor according to a second control signal output by the differential amplifier such that a voltage at an inverting input terminal is substantially equal to the bias voltage.

12 Claims, 3 Drawing Sheets

CONSTANT-VOLTAGE CIRCUIT, SEMICONDUCTOR DEVICE USING THE SAME, AND CONSTANT-VOLTAGE OUTPUTTING METHOD

CROSS-REFERENCE TO RELATED APPLICATIONS

This application is based on and claims priority to Japanese Patent Application No. 2005-018337 filed on Jan. 26, 2005 in the Japanese Patent Office, the entire contents of which are incorporated by reference herein.

FIELD OF THE INVENTION

The invention relates to a method and apparatus for outputting a constant voltage, and particularly to a method and apparatus for outputting a constant voltage at an improved response speed to a change in output voltage.

BACKGROUND OF THE INVENTION

In recent years, power conservation of electric appliances has been demanded from a perspective of environmental protection. A power supply circuit is not an exception. Thus, power conservation of the power supply circuit used in an electric appliance has been in progress. However, reduction in power consumption in the power supply circuit causes degradation in the power supply response and a load response characteristic. In light of this, in a background constant-voltage circuit, a current amount passing through its differential amplifier circuit is automatically controlled such that the current amount is increased at such occasions as power-on when a difference between an output voltage and a reference voltage is relatively large, and the current amount is reduced when the output voltage is close to an expected value. Thereby, the background constant-voltage circuit reduces an amount of its consumption current as a whole, while maintaining its response performance.

To improve the load response characteristic, and particularly to cope with a rapid increase in a load current, another background constant-voltage circuit additionally includes a high-speed alternating-current amplifier circuit. Thus, the background constant-voltage circuit quickly sends a voltage corresponding to a change in the output voltage back to a control electrode of an output voltage control transistor. Accordingly, the background constant-voltage circuit consumes a relatively small amount of current, while maintaining a high-speed load response characteristic.

The background constant-voltage circuit includes an alternating-current amplifier circuit including an operational amplifier circuit for improving a response speed to the change in a load current. In this background constant-voltage circuit, an offset voltage is generated at one input terminal of the operational amplifier circuit to establish a dead-zone voltage responsive to the change in the output voltage. Further, the alternating-current amplifier circuit is operated only when the change in the output voltage exceeds a predetermined value. Thereby, unnecessary consumption of current is prevented.

However, the background constant-voltage circuit including the operational amplifier circuit is integrated on a semiconductor device. Thus, the offset voltage generated in the input circuit of the operational amplifier circuit substantially changes due to variations of semiconductor devices occurring in a manufacturing process. To secure the offset voltage at the minimum level required for generating the dead-zone voltage, therefore, a design value range of the offset voltage needs to be relatively large in consideration of the variations. Therefore, in a case in which the offset voltage is substantially increased, for example, variations in the output voltage needs to be relatively large so as to drive and operate the alternating-current amplifier circuit. As a result, the load response characteristic is not much improved.

BRIEF SUMMARY OF THE INVENTION

This patent specification describes a novel constant-voltage circuit. In one example, a novel constant-voltage circuit includes an input terminal pulled up to an input voltage and an output terminal outputting an output voltage. The constant-voltage circuit further includes a first transistor, a first control circuit, and a second control circuit having a second transistor and a differential amplifier. The first transistor is configured to control an output current flowing from the input terminal to the output terminal in accordance with a first control signal. The first control circuit is configured to control the first transistor by outputting the first control signal such that the output voltage output from the output terminal is substantially equal to a predetermined voltage. The second control circuit has a response property faster than the first control circuit to a variation of the output voltage, and is configured to cause the first transistor to increase the output current for a predetermined time period, regardless of the first control signal, when the output voltage varied to an extent greater than a predetermined output voltage variation value. The second transistor is configured to control an operation of the first transistor in accordance with a second control signal. The differential amplifier includes a non-inverting input terminal connected to a bias voltage, and an inverting input terminal connected to the non-inverting input terminal via a resistor and to the output terminal via a capacitor. The differential pair includes third and fourth transistors. The third transistor is configured to have a current drive capability variably set to determine the predetermined output voltage variation value. Further, the differential amplifier is configured to control an operation of the second transistor by outputting the second control signal such that a voltage at the inverting input terminal is substantially equal to the bias voltage.

This patent specification further describes a novel constant-voltage outputting method. In one example, a novel constant-voltage outputting method includes: providing a first transistor, a first control circuit, and a second control circuit including a second transistor and a differential amplifier, the differential amplifier having a differential pair of third and fourth transistors; causing the first control circuit to output a first control signal; causing the first transistor to control an output current according to the first control signal; inputting a bias voltage in a non-inverting input terminal of the differential amplifier and equalizing a voltage at an inverting input terminal of the differential amplifier to the bias voltage; causing the differential amplifier to output a second control signal; causing the second transistor to control operation of the first transistor according to the second control signal; and causing the first transistor to increase the output current for a predetermined time period, regardless of the first control signal, when an output voltage varied to an extent greater than a predetermined output voltage variation value, the predetermined output voltage variation value being determined by variably setting a current drive capability of the third transistor.

This patent specification further describes a novel semiconductor device. In one example, a novel semiconductor device includes a constant-voltage circuit having an input terminal pulled up to an input voltage and an output terminal outputting an output voltage. The constant-voltage circuit further includes a first transistor, a first control circuit, and a second control circuit having a second transistor and a differential amplifier. The first transistor is configured to control an output current flowing from the input terminal to the output terminal in accordance with a first control signal. The first control circuit is configured to control the first transistor by outputting the first control signal such that the output voltage output from the output terminal is substantially equal to a predetermined voltage. The second control circuit has a response property faster than the first control circuit to a variation of the output voltage, and is configured to cause the first transistor to increase the output current for a predetermined time period, regardless of the first control signal, when the output voltage varied to an extent greater than a predetermined output voltage variation value. The second transistor is configured to control an operation of the first transistor in accordance with a second control signal. The differential amplifier includes a non-inverting input terminal connected to a bias voltage, and an inverting input terminal connected to the non-inverting input terminal via a resistor and to the output terminal via a capacitor. The differential pair includes third and fourth transistors. The third transistor is configured to have a current drive capability variably set to determine the predetermined output voltage variation value. Further, the differential amplifier is configured to control an operation of the second transistor by outputting the second control signal such that a voltage at the inverting input terminal is substantially equal to the bias voltage.

BRIEF DESCRIPTION OF THE DRAWINGS

A more complete appreciation of the disclosure and many of the advantages thereof are readily obtained as the same becomes better understood by reference to the following detailed description when considered in connection with the accompanying drawings, wherein.

DETAILED DESCRIPTION OF THE INVENTION

Figure 1:
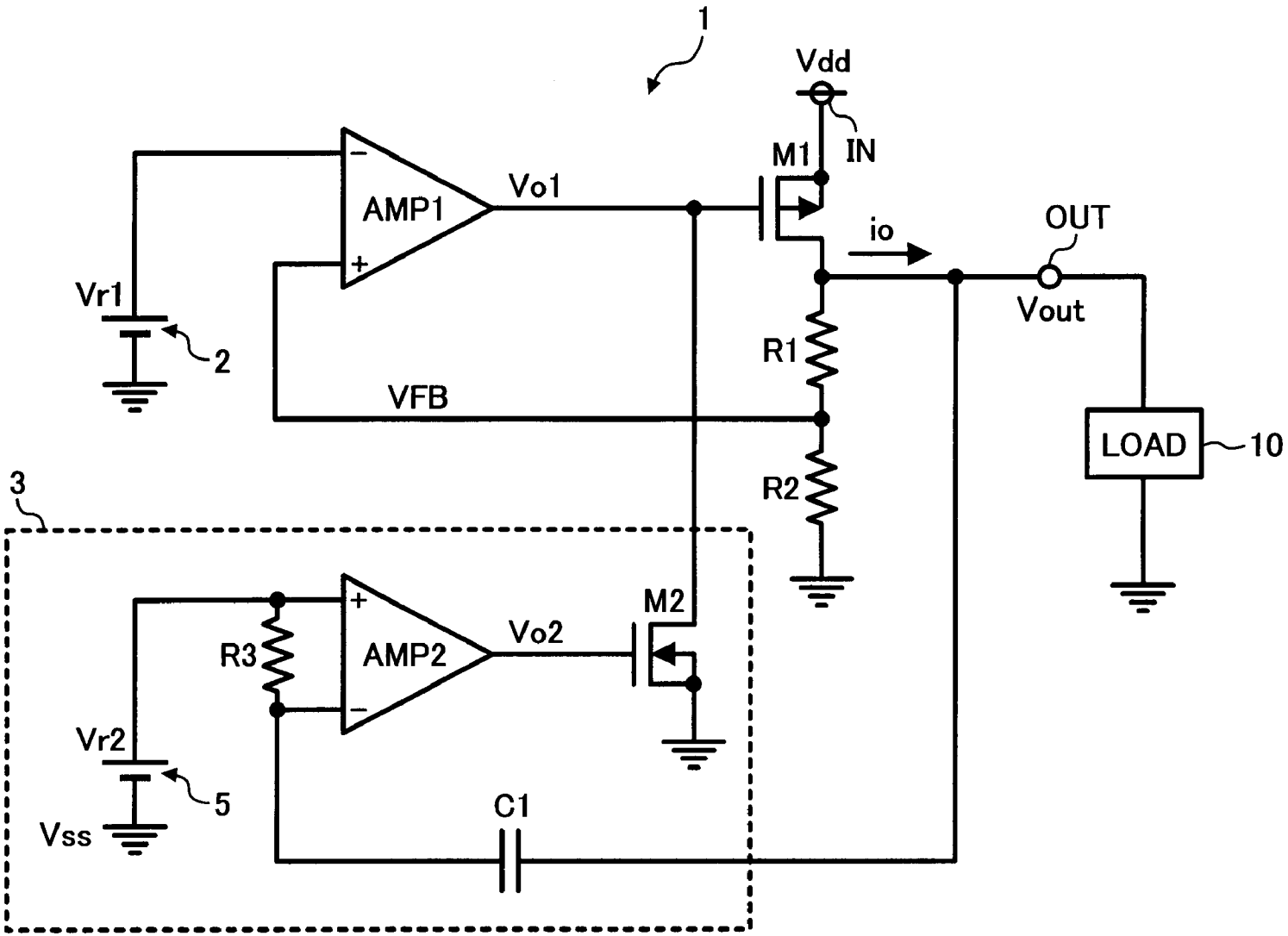
FIG. 1 is a circuit diagram illustrating an exemplary configuration of a constant-voltage circuit according to an embodiment of the invention.

In describing preferred embodiments illustrated in the drawings, specific terminology is employed for the purpose of clarity. However, the disclosure of this patent specification is not intended to be limited to the specific terminology so used and it is to be understood that substitutions for each specific element can include any technical equivalents that operate in a similar manner.

Referring now to the drawings, wherein like reference numerals designate identical or corresponding parts throughout the several views, FIG. 1 illustrates an exemplary configuration of a constant-voltage circuit 1 according to an embodiment of the invention.

The constant-voltage circuit 1 illustrated in FIG. 1 is integrated on a semiconductor device which performs a predetermined function. The constant-voltage circuit 1 generates a predetermined constant voltage from a power supply voltage Vdd input at an input terminal IN, and outputs the constant voltage as an output voltage Vout from an output terminal OUT. A load 10 is connected between the output terminal OUT and a ground voltage terminal.

The constant-voltage circuit 1 includes a reference voltage generator circuit 2, resistors R1 and R2, an output voltage control transistor M1, an operational amplifier circuit AMP1, and an alternating-current amplifier circuit 3. The reference voltage generator circuit 2 generates and outputs a predetermined reference voltage Vr1. The resistors R1 and R2 divide the output voltage Vout to generate and output a divided voltage VFB. The output voltage control transistor M1 is formed by a PMOS (P-channel metal oxide semiconductor) transistor which controls, according to a control signal input at its gate, an output current io output to the output terminal OUT. The operational amplifier circuit AMP1 controls operation of the output voltage control transistor M1 such that the divided voltage VFB is equalized to the reference voltage Vr1. When a change in the output voltage Vout exceeds a predetermined value, the alternating-current amplifier circuit 3 amplifies an alternating-current component of the change for a predetermined time period, and causes the output voltage control transistor M1 to increase the output current io independently of the control signal sent from the operational amplifier circuit AMP1. The alternating-current amplifier circuit 3 includes an operational amplifier circuit AMP2 forming a differential amplifier circuit, an NMOS (N-channel metal oxide semiconductor) transistor M2, a resistor R3, a coupling capacitor C1, and a reference voltage generator circuit 5 for generating and outputting a predetermined reference voltage Vr2.

The output voltage control transistor M1 is connected between the input terminal IN and the output terminal OUT. The resistors R1 and R2 are connected in series between the output terminal OUT and the ground voltage terminal. The reference voltage Vr1 is input at an inverting input terminal of the operational amplifier circuit AMP1, while the divided voltage VFB is input at a non-inverting input terminal of the operational amplifier circuit AMP1. An output terminal of the operational amplifier circuit AMP1 is connected to the gate of the output voltage control transistor M1. The NMOS transistor M2 is connected between the gate of the output voltage control transistor M1 and the ground voltage terminal. A gate of the NMOS transistor M2 is connected to an output terminal of the operational amplifier circuit AMP2. The coupling capacitor C1 is connected between an inverting input terminal of the operational amplifier circuit AMP2 and the output terminal OUT. The reference voltage Vr2 is input at a non-inverting input terminal of the operational amplifier circuit AMP2. The resistor R3 is connected between the inverting terminal and the non-inverting terminal of the operational amplifier circuit AMP2.

In the constant-voltage circuit 1 thus configured, the operational amplifier circuit AMP2 has a smaller amplification rate but a faster response speed than the operational amplifier circuit AMP1. As a result, a voltage corresponding to the change in the output voltage Vout is quickly sent from the coupling capacitor C1 back to the gate of the output voltage control transistor M1 through the operational amplifier circuit AMP2 and the NMOS transistor M2. Therefore, the output voltage control transistor M1 quickly operates in response to the change in the output voltage Vout. Accordingly, the response speed of the constant-voltage circuit 1 to the change in load current can be substantially increased.

Further, the resistor R3 is connected between the two input terminals of the operational amplifier circuit AMP2. When the output voltage Vout output from the constant-voltage circuit 1 is in a stable state, therefore, electric potential is equal at the two input terminals of the operational amplifier circuit AMP2. Thus, an output voltage Vo2 output from the operational amplifier circuit AMP2 substantially changes according to an input offset voltage.

For example, when a negative offset voltage is generated at the non-inverting input terminal of the operational amplifier circuit AMP2 with respect to the inverting input terminal of the operational amplifier circuit AMP2, the output terminal of the operational amplifier circuit AMP2 outputs a relatively high-level signal. Thereby, the NMOS transistor M2 is turned on, and a gate voltage of the output voltage control transistor M1 is decreased to increase the output voltage Vout. To prevent this operation, a relatively large amount of current is flowed from the output terminal of the operational amplifier circuit AMP1 to the NMOS transistor M2. As a result, a current consumption increases. Such unnecessary consumption in current is prevented by generating an offset voltage at one of the input terminals of the operational amplifier circuit AMP2, establishing a dead-zone voltage responsive to the change in the output voltage Vout, and operating the alternating-current amplifier circuit 3 only when the change in the output voltage Vout exceeds a predetermined value. The dead-zone voltage established for the input in the alternating-current amplifier circuit 3 is generated by causing an input circuit of the operational amplifier circuit AMP2 to generate the offset voltage.

Figure 2:
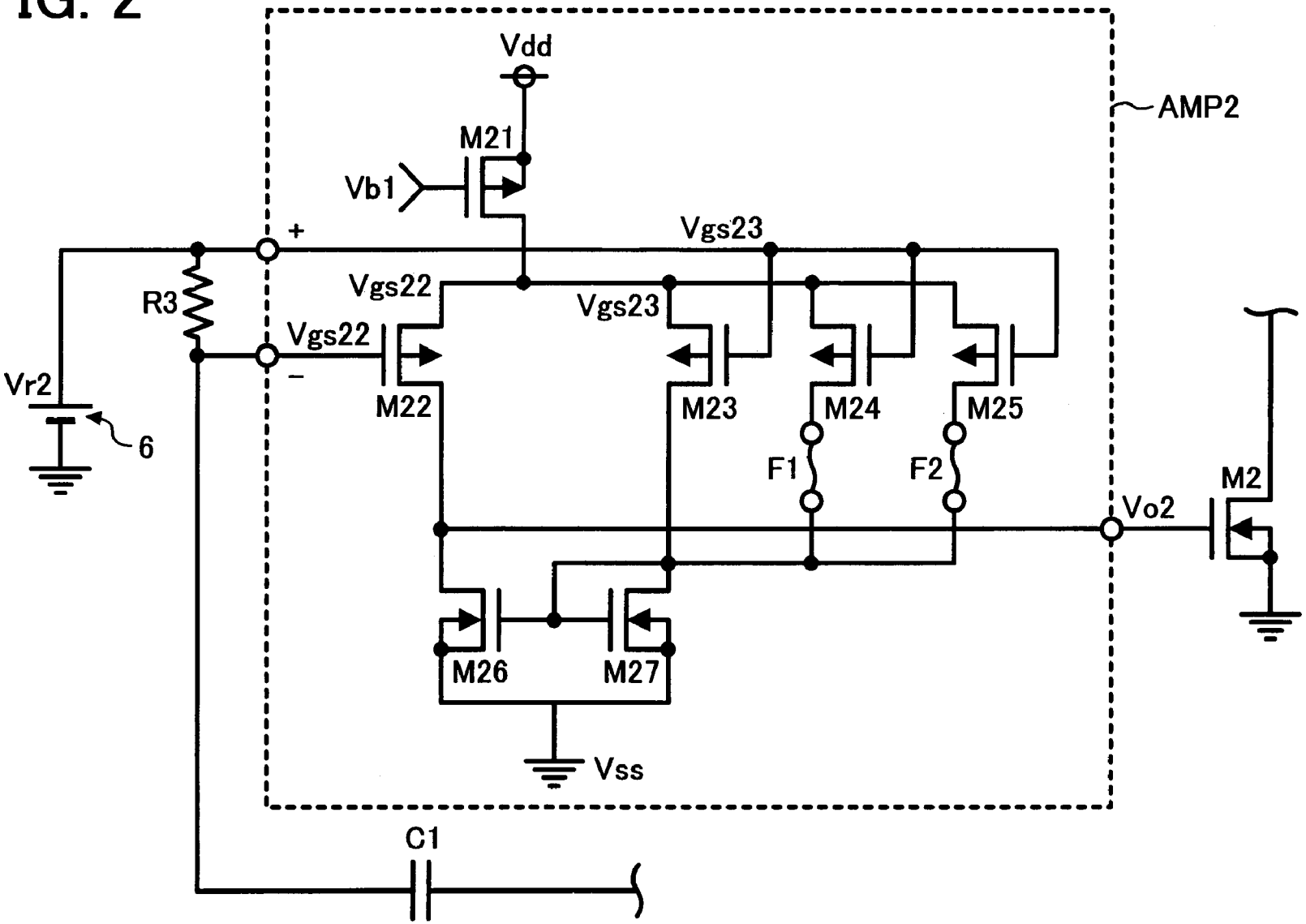
FIG. 2 is a circuit diagram illustrating an exemplary configuration of an operational amplifier circuit used in the constant-voltage circuit illustrated in FIG. 1.

FIG. 2 illustrates an exemplary configuration of the operational amplifier circuit AMP2 used in the constant-voltage circuit 1 illustrated in FIG. 1. The operational amplifier circuit AMP2 illustrated in FIG. 2 includes PMOS transistors M21 to M25, NMOS transistors M26 and M27, and fuses F1 and F2. The PMOS transistors M22 and M23 form a differential pair. The NMOS transistors M26 and M27 form a current mirror circuit, which serves as a load of the differential pair. Sources of the NMOS transistors M26 and M27 are connected to the ground voltage terminal. Further, gates of the NMOS transistors M26 and M27 are connected with each other, and their connection point is connected to a drain of the NMOS transistor M27. A drain of the NMOS transistor M26 is connected to a drain of the PMOS transistor M22, while the drain of the NMOS transistor M27 is connected to a drain of the PMOS transistor M23.

Sources of the PMOS transistors M22 and M22 are connected with each other, and the PMOS transistor M21 is connected between a connection point of the PMOS transistors M22 and M22 and a power supply voltage Vdd. The PMOS transistor M21 has a gate for receiving input of a predetermined constant voltage Vb1 and forms a constant current source. The constant voltage Vb1 may be externally input at the gate of the PMOS transistor M21. Alternatively, a circuit for generating the constant voltage Vb1 may be provided in the operational amplifier circuit AMP2. The PMOS transistor M24 and the fuse F1 form a series circuit, and the PMOS transistor M25 and the fuse F2 form another series circuit. The two series circuits are connected in parallel to the PMOS transistor M23. Gates of the PMOS transistors M23 to M25 are connected with one another, and a connection point of the gates forms the non-inverting input terminal of the operational amplifier circuit AMP2. Meanwhile, a gate of the PMOS transistor M22 forms the inverting input terminal of the operational amplifier circuit AMP2. A connection point between the PMOS transistor M22 and the NMOS transistor M26 forms the output terminal of the operational amplifier circuit AMP2, and is connected to the gate of the NMOS transistor M2.

In the operational amplifier circuit AMP2 thus configured, the input offset voltage of the operational amplifier circuit AMP2 is generated by differentiating the element size between the PMOS transistors M22 and M23. That is, if the PMOS transistor M23 is larger than the PMOS transistor M22 in the element size, and if drain currents of an equal amount are flowed through the PMOS transistors M22 and M23, a gate-source voltage becomes smaller in the PMOS transistor M23 than in the PMOS transistor M22. Accordingly, a positive offset voltage can be generated at the non-inverting input terminal of the operational amplifier circuit AMP2.

In an initial state, the PMOS transistors M23 to M25 on the side of the non-inverting input terminal of the operational amplifier circuit AMP2 are connected in parallel. Thus, a gate-source voltage Vgs23 of the PMOS transistor M23 is substantially smaller than a gate-source voltage Vgs22 of the PMOS transistor M22. Therefore, a larger positive offset voltage is generated at the non-inverting input terminal than at the inverting input terminal of the operational amplifier circuit AMP2. The offset voltage can be reduced by cutting at least one of the fuses F1 and F2 according to a trimming technique. That is, the offset voltage can be approximated to a predetermined voltage by cutting at least one of the fuses F1 and F2 to compensate for variations in semiconductor devices occurring in the manufacturing process.

In the constant-voltage circuit 1 described above, the reference voltage generator circuit 2, the operational amplifier circuit AMP1, and the resistors R1 and R2 form a first control circuit. Meanwhile, the alternating-current amplifier circuit 3 forms a second control circuit. The NMOS transistor M2 forms a control transistor, and the PMOS transistor M22 and the PMOS transistor M23 form a first transistor and a second transistor, respectively. The PMOS transistor M24 and the PMOS transistor M25 form third transistors.

The operational amplifier circuit AMP2 according to the present embodiment includes the two series circuits, each of which includes a PMOS transistor and a fuse connected in series to each other. Further, the two series circuits are connected in parallel to the PMOS transistor M23. However, the operational amplifier circuit AMP2 according to the present embodiment is not limited to the above configuration. That is, the operational amplifier circuit AMP2 includes at least one series circuit including a PMOS transistor and a fuse.

Figure 3:
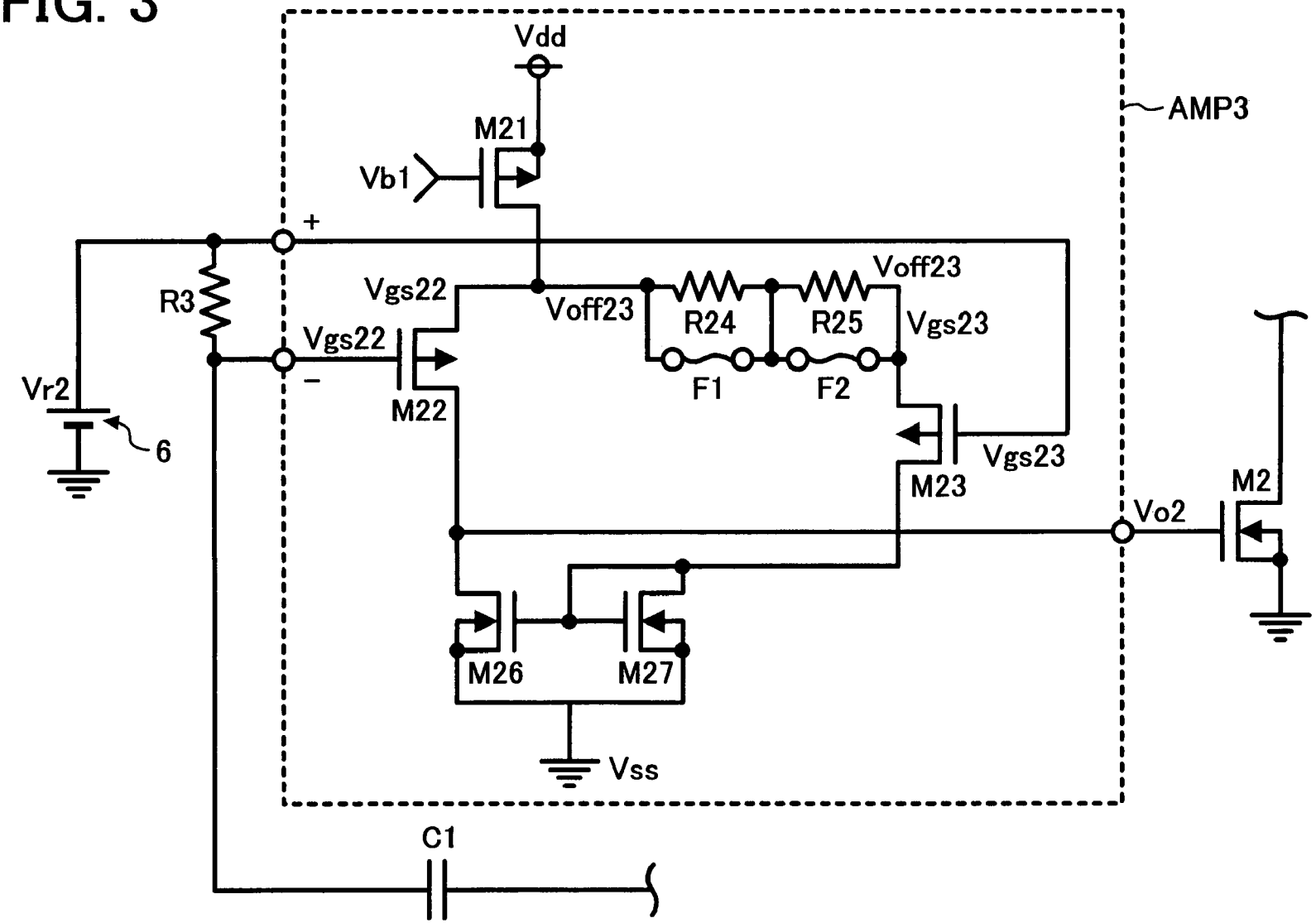
FIG. 3 is a circuit diagram illustrating another exemplary configuration of the operational amplifier circuit used in the constant-voltage circuit illustrated in FIG. 1.

FIG. 3 illustrates an exemplary configuration of an operational amplifier circuit AMP3 according to another embodiment. Operational amplifier circuit AMP3 may be used in constant-voltage circuit 1 instead of operational amplifier circuit AMP2 The operational amplifier circuit AMP3 illustrated in FIG. 3 includes the PMOS transistors M21 to M23, the NMOS transistors M26 and M27, resistors R24 and R25, and the fuses F1 and F2. As in the operational amplifier circuit AMP2, the PMOS transistors M22 and M23 form the differential pair, and the NMOS transistors M26 and M27 form the current mirror circuit, serving as the load of the differential pair. Further, the sources of the NMOS transistors M26 and M27 are connected to the ground voltage terminal. The gates of the NMOS transistors M26 and M27 are connected with each other, and their connection point is connected to the drain of the NMOS transistor M27. The drain of the NMOS transistor M26 is connected to the drain of the PMOS transistor M22, while the drain of the NMOS transistor M27 is connected to the drain of the PMOS transistor M23.

The PMOS transistor M21 is connected between the source of the PMOS transistor M22 and the power supply voltage Vdd. The gate of the PMOS transistor M21 receives input of the predetermined constant voltage Vb1, and the PMOS transistor M21 forms the constant current source. The constant voltage Vb1 may be externally input at the gate of the PMOS transistor M21. Alternatively, the circuit for generating the constant voltage Vb1 may be provided in the operational amplifier circuit AMP3. The resistors R24 and R25 are connected in series between the source of the PMOS transistor M22 and the source of the PMOS transistor M23. The resistor R24 is connected in parallel to the fuse F1, while the resistor R25 is connected in parallel to the fuse F2. The gate of the PMOS transistor M23 forms a non-inverting input terminal of the operational amplifier circuit AMP3. Meanwhile, the gate of the PMOS transistor M22 forms an inverting input terminal of the operational amplifier circuit AMP3. The connection point between the PMOS transistor M22 and the NMOS transistor M26 forms an output terminal of the operational amplifier circuit AMP3, and is connected to the gate of the NMOS transistor M2.

In the operational amplifier circuit AMP3 thus configured, an input offset voltage of the operational amplifier circuit AMP3 is generated by differentiating the element size between the PMOS transistors M22 and M23. That is, if the PMOS transistor M23 is larger than the PMOS transistor M22 in the element size, and if drain currents of an equal amount are flowed through the PMOS transistors M22 and M23, respectively, the gate-source voltage becomes smaller in the PMOS transistor M23 than in the PMOS transistor M22. Therefore, a positive offset voltage can be generated at the non-inverting input terminal of the operational amplifier circuit AMP3.

In an initial state, the source of the PMOS transistor M23 on the side of the non-inverting input terminal of the operational amplifier circuit AMP3 is connected to the source of the PMOS transistor M22 via the fuses F1 and F2. Provided that resistance values of the fuses F1 and F2 are negligible compared with resistance values of the resistors R24 and R25, the offset voltage of the operational amplifier circuit AMP3 is determined by a difference between the gate-source voltage Vgs23 of the PMOS transistor M23 and the gate-source voltage Vgs22 of the PMOS transistor M22. The PMOS transistor M23 is larger than the PMOS transistor M22 in the element size. Therefore, the gate-source voltage Vgs23 of the PMOS transistor M23 is substantially smaller than the gate-source voltage Vgs22 of the PMOS transistor M22.

Accordingly, a larger positive offset voltage is generated at the non-inverting input terminal than at the inverting input terminal of the operational amplifier circuit AMP3. If at least one of the fuses F1 and F2 is cut according to the trimming technique, the resistors R24 and R25 are connected in series to the PMOS transistors M22 and M23. Thus, current flows through at least one of the resistors R24 and R25, and a voltage Voff23 is generated at opposite ends of the series circuit including the resistors R24 and R25. Therefore, a difference between the gate-source voltage Vgs23 of the PMOS transistor M23 and the gate-source voltage Vgs22 of the PMOS transistor M22 (i.e., the offset voltage) can be reduced. Accordingly, the offset voltage can be approximated to a predetermined voltage by cutting at least one of the fuses F1 and F2 to compensate for variations in semiconductor devices occurring in the manufacturing process.

The operational amplifier circuit AMP3 according to the present embodiment includes the two resistors R24 and R25 connected in series to the PMOS transistor M23, and the two fuses F1 and F2 connected in parallel to their corresponding resistors R24 and R25. The operational amplifier circuit AMP3 according to the present embodiment is one of examples and is not limited to the above configuration. That is, the operational amplifier circuit AMP3 includes at least one resistor connected in series to the PMOS transistor M23 and at least one fuse connected in parallel to the resistor.

In the constant-voltage circuit 1 according to the embodiment as described above, variations in the offset voltage of the operational amplifier circuit AMP2 or AMP3 forming the alternating-current amplifier circuit 3 are reduced as much as possible by trimming at least one of the fuses F1 and F2. Accordingly, the dead-zone voltage of the alternating-current amplifier circuit 3 is reduced, and thus the load response characteristic of the constant-voltage circuit 1 can be improved.

The above-described embodiments are illustrative, and numerous additional modifications and variations are possible in light of the above teachings. For example, elements and/or features of different illustrative and exemplary embodiments herein may be combined with each other and/or substituted for each other within the scope of this disclosure and appended claims. It is therefore to be understood that within the scope of the appended claims, the disclosure of this patent specification may be practiced otherwise than as specifically described herein.

What is claimed as new and desired to be protected by Letters Patent of the United States is:

1. A constant-voltage circuit having an input terminal pulled up to an input voltage and an output terminal outputting an output voltage, the constant-voltage circuit comprising:

a first transistor configured to control an output current flowing from the input terminal to the output terminal in accordance with a first control signal;

a first control circuit configured to control the first transistor by outputting the first control signal such that the output voltage output from the output terminal is substantially equal to a predetermined voltage;

a second control circuit having a response property faster than the first control circuit to a variation of the output voltage and configured to cause the first transistor to increase the output current for a predetermined time period, regardless of the first control signal, when the output voltage varied to an extent greater than a predetermined output voltage variation value, the second control circuit including:

a second transistor configured to control an operation of the first transistor in accordance with a second control signal, and a differential amplifier including a non-inverting input terminal connected to a bias voltage, an inverting input terminal connected to the non-inverting input terminal via a resistor and to the output terminal via a capacitor, and a differential pair of third and fourth transistors, the third transistor configured to have a current drive capability variably set to determine the predetermined output voltage variation value, and configured to control an operation of the second transistor by outputting the second control signal such that a voltage at the inverting input terminal is substantially equal to the bias voltage.

2. The constant-voltage circuit of claim 1, wherein the current drive capability of the third transistor is set to be different from a current drive capability of the fourth transistor for generating an offset voltage of the differential amplifier.

3. The constant-voltage circuit of claim 2, wherein the differential pair further includes at least one series circuit connected in parallel thereto, each of the at least one series circuit comprising:

a fifth transistor having a control electrode connected to a control electrode of the fourth transistor; and a fuse connected in series to the fifth transistor, wherein the third transistor has a control electrode forming the inverting input terminal, and the fourth transistor has a control electrode forming the non-inverting input terminal, and wherein the current drive capability of the third transistor is set by cutting the fuse selected.

4. The constant-voltage circuit of claim 2, wherein the differential pair further includes:

at least one resistor connected in series to the fourth transistor; and at least one fuse connected in parallel to the corresponding at least one resistor, wherein the third transistor has a control electrode forming the inverting input terminal, and the fourth transistor has a control electrode forming the non-inverting input terminal, and wherein the current drive capability of the third transistor is set by cutting the fuse selected.

5. A constant-voltage outputting method comprising:

providing a first transistor, a first control circuit, and a second control circuit including a second transistor and a differential amplifier, the differential amplifier having a differential pair of third and fourth transistors;

causing the first control circuit to output a first control signal;

causing the first transistor to control an output current according to the first control signal;

inputting a bias voltage in a non-inverting input terminal of the differential amplifier and equalizing a voltage at an inverting input terminal of the differential amplifier to the bias voltage;

causing the differential amplifier to output a second control signal;

causing the second transistor to control operation of the first transistor according to the second control signal; and causing the first transistor to increase the output current for a predetermined time period, regardless of the first control signal, when an output voltage varied to an extent greater than a predetermined output voltage variation value, the predetermined output voltage variation value being determined by variably setting a current drive capability of the third transistor.

6. The constant-voltage outputting method of claim 5, wherein the inputting step comprising:

setting the current drive capability of the third transistor to be different from a current drive capability of the fourth transistor for generating an offset voltage of the differential amplifier.

7. The constant-voltage outputting method of claim 6, wherein the setting step comprises:

cutting at least one fuse included in at least one series circuit connected in parallel to the differential pair, each of the at least one series circuit including a fifth transistor having a control electrode connected to a control electrode of the fourth transistor, and a fuse connected in series to the fifth transistor.

8. The constant-voltage outputting method of claim 6, wherein the setting step comprises:

cutting at least one fuse connected in parallel to corresponding at least one resistor which is connected in series to the fourth transistor.

9. A semiconductor device comprising:

a constant-voltage circuit having an input terminal pulled up to an input voltage and an output terminal outputting an output voltage, the constant-voltage circuit including:

a first transistor configured to control an output current flowing from the input terminal to the output terminal in accordance with a first control signal, a first control circuit configured to control the first transistor by outputting the first control signal such that the output voltage output from the output terminal is substantially equal to a predetermined voltage, a second control circuit having a response property faster than the first control circuit to a variation of the output voltage and configured to cause the first transistor to increase the output current for a predetermined time period, regardless of the first control signal, when the output voltage varied to an extent greater than a predetermined output voltage variation value, the second control circuit including:

a second transistor configured to control an operation of the first transistor in accordance with a second control signal, and a differential amplifier including a non-inverting input terminal connected to a bias voltage, an inverting input terminal connected to the non-inverting input terminal via a resistor and to the output terminal via a capacitor, and a differential pair of third and fourth transistors, the third transistor configured to have a current drive capability variably set to determine the predetermined output voltage variation value, and configured to control an operation of the second transistor by outputting the second control signal such that a voltage at the inverting input terminal is substantially equal to the bias voltage.

10. The semiconductor device of claim 9, wherein the current drive capability of the third transistor is set to be different from a current drive capability of the fourth transistor for generating an offset voltage of the differential amplifier.

11. The semiconductor device of claim 10, wherein the differential pair further includes at least one series circuit connected in parallel thereto, each of the at least one series circuit comprising:

a fifth transistor having a control electrode connected to a control electrode of the fourth transistor; and a fuse connected in series to the fifth transistor, wherein the third transistor has a control electrode forming the inverting input terminal, and the fourth transistor has a control electrode forming the non-inverting input terminal, and wherein the current drive capability of the third transistor is set by cutting the fuse selected.

12. The semiconductor device of claim 10, wherein the differential pair further includes:

at least one resistor connected in series to the fourth transistor; and at least one fuse connected in parallel to the corresponding at least one resistor, wherein the third transistor has a control electrode forming the inverting input terminal, and the fourth transistor has a control electrode forming the non-inverting input terminal, and wherein the current drive capability of the third transistor is set by cutting the fuse selected.

* * * * *